US008826981B2

(12) United States Patent
van Hal et al.

(10) Patent No.: US 8,826,981 B2
(45) Date of Patent: Sep. 9, 2014

(54) SYSTEM AND METHOD FOR FLUID PROCESSING WITH VARIABLE DELIVERY FOR DOWNHOLE FLUID ANALYSIS

(75) Inventors: Ronald E. G. van Hal, Watertown, MA (US); Jimmy Lawrence, Amherst, MA (US); Jane T. Lam, Randolph, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/247,411

(22) Filed: Sep. 28, 2011

(65) Prior Publication Data

US 2013/0075093 A1 Mar. 28, 2013

(51) Int. Cl.
*E21B 49/08* (2006.01)

(52) U.S. Cl.
CPC ..... *E21B 49/081* (2013.01)
USPC ..... 166/264; 166/250.12; 73/152.42

(58) Field of Classification Search
USPC ..... 166/264, 252.6, 250.12; 73/152.18, 73/152.23, 152.24, 152.42
See application file for complete search history.

(56) References Cited

U.S. PATENT DOCUMENTS

| | | | | |
|---|---|---|---|---|
| 2,977,199 | A | 3/1961 | Quittner | |
| 3,174,547 | A | 3/1965 | Fields | |
| 3,212,576 | A | 10/1965 | Lanmon, II | |
| 3,329,204 | A | 7/1967 | Brieger | |
| 3,347,314 | A | 10/1967 | Schuster | |
| 3,347,315 | A | 10/1967 | Lanmon, II | |
| 3,347,322 | A | 10/1967 | Lanmon, II | |
| 3,394,767 | A | 7/1968 | Terry | |
| 3,507,340 | A | 4/1970 | Voetter | |
| 4,892,383 | A | 1/1990 | Klainer et al. | |
| 5,059,790 | A | 10/1991 | Klainer et al. | |
| 5,107,133 | A | 4/1992 | Klainer | |
| 5,116,759 | A | 5/1992 | Klainer et al. | |
| 5,192,509 | A | 3/1993 | Surjaatmadja et al. | |
| 5,273,190 | A | 12/1993 | Lund | |
| 5,747,674 | A * | 5/1998 | Moracchini et al. | 73/61.44 |
| 6,402,364 | B1 | 6/2002 | Esclar et al. | |
| 6,578,409 | B1 * | 6/2003 | Zhou et al. | 73/53.01 |
| 6,719,729 | B2 | 4/2004 | Sogaro | |
| 6,995,360 | B2 | 2/2006 | Jones et al. | |
| 7,025,138 | B2 | 4/2006 | Kurkjian et al. | |
| 7,118,349 | B2 | 10/2006 | Oglesby | |
| 7,458,252 | B2 * | 12/2008 | Freemark et al. | 73/64.45 |
| 7,511,819 | B2 | 3/2009 | DiFoggio | |

(Continued)

FOREIGN PATENT DOCUMENTS

| | | |
|---|---|---|
| EP | 2021769 | 2/2009 |
| WO | 20070143474 | 12/2007 |

*Primary Examiner* — Kenneth L Thompson
*Assistant Examiner* — Catherine Loikith
(74) *Attorney, Agent, or Firm* — Jakub M. Michna; Bridget Laffey

(57) ABSTRACT

Described herein are variable-volume reservoir (e.g., syringe pump) based processes and systems usable to characterize samples of reservoir fluids, without having to first transport the fluids to the surface. Variable-volume reservoirs are used, for example, for one or more of storing reactants, controlling mixing ratios and storing used chemicals. The processes and systems can be used in various modes, such as continuous mixing mode, flow injection analysis, and titrations. A fluid interrogator, such as a spectrometer, can be used to detect a change in a physical property of the mixture, which is indicative of an analyte within the mixture. In at least some embodiments, a concentration of the analyte solution can be determined from the detected physical property.

24 Claims, 10 Drawing Sheets

(56) References Cited

U.S. PATENT DOCUMENTS

| | | | | |
|---|---|---|---|---|
| 7,516,654 | B2 | 4/2009 | DiFoggio | |
| 7,523,648 | B2 | 4/2009 | Zougari | |
| 7,581,435 | B2 * | 9/2009 | Pelletier | 73/54.02 |
| 7,814,782 | B2 | 10/2010 | DiFoggio | |
| 7,937,223 | B2 | 5/2011 | Ciglenec et al. | |
| 7,959,864 | B2 | 6/2011 | Jiang et al. | |
| 8,032,303 | B2 | 10/2011 | Fujisawa et al. | |
| 8,039,791 | B2 | 10/2011 | Dong et al. | |
| 8,056,408 | B2 | 11/2011 | Pop et al. | |
| 8,058,071 | B2 | 11/2011 | Jiang et al. | |
| 8,068,226 | B2 | 11/2011 | Csutak | |
| 8,082,780 | B2 | 12/2011 | Vannuffelen et al. | |
| 8,165,817 | B2 | 4/2012 | Betancourt et al. | |
| 8,379,207 | B2 | 2/2013 | DiFoggio et al. | |
| 8,518,702 | B2 | 8/2013 | Jiang et al. | |
| 2002/0087122 | A1 | 7/2002 | Sogaro | |
| 2003/0134426 | A1 | 7/2003 | Jiang et al. | |
| 2006/0008382 | A1 * | 1/2006 | Salamitou et al. | 422/57 |
| 2006/0070426 | A1 | 4/2006 | Pelletier | |
| 2006/0243047 | A1 | 11/2006 | Terabayashi et al. | |
| 2008/0111064 | A1 | 5/2008 | Andrews et al. | |
| 2009/0302221 | A1 | 12/2009 | Tavernier et al. | |
| 2010/0147065 | A1 | 6/2010 | Tan et al. | |
| 2010/0181472 | A1 | 7/2010 | Csutak | |
| 2011/0023594 | A1 | 2/2011 | Pelletier et al. | |
| 2012/0137764 | A1 | 6/2012 | Lawrence et al. | |
| 2012/0138364 | A1 | 6/2012 | Leonard et al. | |
| 2012/0145400 | A1 | 6/2012 | Harrison et al. | |
| 2012/0149117 | A1 | 6/2012 | Lawrence et al. | |
| 2012/0149604 | A1 | 6/2012 | Lawrence et al. | |
| 2012/0199365 | A1 | 8/2012 | Patel et al. | |
| 2012/0273203 | A1 | 11/2012 | Lawrence et al. | |
| 2012/0276648 | A1 | 11/2012 | van Hal et al. | |
| 2013/0020077 | A1 | 1/2013 | Irani et al. | |
| 2013/0056626 | A1 | 3/2013 | Shen et al. | |
| 2013/0071934 | A1 | 3/2013 | Indo et al. | |
| 2013/0104642 | A1 | 5/2013 | Pelletier et al. | |
| 2013/0118734 | A1 | 5/2013 | Csutak | |
| 2013/0188169 | A1 | 7/2013 | Harrison et al. | |

* cited by examiner

SYSTEM AND METHOD FOR FLUID PROCESSING WITH VARIABLE DELIVERY FOR DOWNHOLE FLUID ANALYSIS

BACKGROUND

1. Technical Field

This application relates generally to fluid processing. More particularly, this application relates to chemical analysis of fluid samples within a wellbore environment.

2. Background Information

Chemical analysis is a critical step in the evaluation of the hydrocarbon reserves. The fluid/gas composition has a large impact on the economic value of the reservoir. Furthermore, the fluid/gas composition determines the well completion and production strategies. Traditionally, samples are taken in the field, shipped to a laboratory, often reconstituted to reservoir conditions and then analyzed.

Many components have to be analyzed downhole due to changes as a result of the sampling. For example, the pH of a water sample can change due to the outgassing of carbon dioxide ($CO_2$) or hydrogen sulfide ($H_2S$). Hydrogen sulfide in gas or oil can be scavenged by metal parts or the sample bottle and barium in water can even precipitate as barium sulfate before the sample is taken.

Spectroscopic techniques are able to determine some components in the oil/gas without any preparation. An example of this is the compositional analysis as performed by an analyzer, such as the Compositional Fluid Analyzer (CFA) module of the Modular Formation Dynamics Tester (MDT), a tool suite commercially available from Schlumberger Technology Corporation, Sugar Land, Tex. However, the number of components that can be determined directly by spectroscopic techniques is limited. Adding a color agent (dye) to the solution to determine one component of the fluid has been proven to be a successful method for the determination of pH (e.g., using a Live Fluid Analyzer, LFA-pH module of the MDT).

Within certain limits, the dye concentration is generally of little or no importance in the case of a pH measurement. However, pH measurements are the exception and most other measurements require a known mixing ratio between reagent and sample. An example is a newly developed method to determine hydrogen sulfide concentration in oil, gas or water by a colorimetric reaction with a metal ion.

Titration is a common method to determine the concentration of a target component in solution. In a titration one reagent is slowly added to a sample solution of the target component (or vice versa) until a sudden event (e.g., color change, precipitation, or other observable change) takes place. The slow addition of one component (reagent) to a solution of another component (target) equates to a slow variation of the mixing ratio of the two components. However, in order to determine the concentration of the target component, the final mixing ratio has to be known. An example relates to determining alkalinity of a solution (sample). The sample is slowly titrated with acid in the presence of a pH sensitive dye, until a color change takes place due to the pH sensitive dye responding to a pH of the titrated sample.

A common approach in chemical analysis is the use of flow injection analysis (FIA). FIA is a helpful technique, particularly for situations in which a chemical sensor may not be very stable, only small amounts are available, or when a reaction product has to be measured in-situ. The FIA technique can be used to compare a mixture's response to an injection of reagent with a baseline response. FIA measurements can compensate for drift in a detector or in case of a colorimetric reaction, for the background coloration of the reagent.

Chemical analysis, particularly in the evaluation of the hydrocarbon reserves, will very likely use more and more chemicals that may not be "environmental friendly." At least one such example relates to analysis of a sample to detect the presence of hydrogen sulfide in oil and gas, in which a reaction with metal ions is suggested as a suitable sensing technique. Suitable metals for use in such situations can include cadmium which is known carcinogenic. Thus, collecting the waste of such chemical reactions would be desirable, as an example of good citizenship. Furthermore, some environmentally sensitive areas (e.g., Alaska) require that no chemicals be left behind during testing and production of an oil well.

SUMMARY

Downhole fluid analysis plays an important role in reservoir characterization. To continue the development of this field more complex chemical analyses have to be performed including downhole chemical reactions. Devices and processes adapted for such downhole analysis, such as mini- and micro-fluidics, can play an important role in this development. Described herein are variable-volume reservoir (e.g., plunger) based systems that can be used to characterize samples of reservoir fluids, without having to first transport the fluids to the surface. The reservoirs can be used, for example, for one or more of storing reactants, controlling the mixing ratio's and storing the used chemicals. The systems can be used in a continuous mode, for flow injection and for titrations.

In one aspect, at least one embodiment described herein provides a downhole fluid processing device includes a first variable-volume reservoir pre-loaded with a reactant. The first reservoir has an open end in fluid communication with a fluid conduit. The device also includes a second variable-volume reservoir, likewise having an open end in fluid communication with the fluid conduit. In some embodiments, one or more of the first and second variable-volume reservoirs include a syringe pump. A fluid mixer is serially disposed along the fluid conduit at a location between open ends of the first and second variable-volume reservoirs. The fluid mixer can include one or more of passive and active mixers. The device further includes a sample port configured to receive from a high-pressure flowline a sample of fluids withdrawn from a subterranean formation. The sample port is in fluid communication with the fluid conduit at a location between the open end of the first variable-volume reservoir and the fluid mixer. A selectable mixture of the reactant and the sampled fluids is obtainable by varying volumes of the first and second variable-volume reservoirs.

In some embodiments, the device includes one or more of an isolation valve disposed between the sample port and the fluid conduit and a filter in fluid communication with the sample port. A windowed fluid conduit can be provided in serial fluid communication with the fluid conduit between the mixer and the open end of the second variable-volume reservoir. An illumination source and detector can be arranged in view of the windowed fluid conduit, such that the source-detector combination allows for observation of optical properties of the mixture of the reactant and the sampled fluids.

In some embodiments, the device includes a third variable-volume reservoir having an open end in fluid communication between the sample port and the fluid conduit. A first isolation valve is disposed between the open end of the third variable-volume reservoir and the sample port. The first isolation valve is adapted to selectively isolate the third variable-volume reservoir from the sample port, while allowing fluid communication between the third variable-volume reservoir and the fluid conduit. A second isolation valve is also provided, being disposed between the open end of the third variable-volume reservoir and the fluid conduit. The second isolation valve is adapted to selectively isolate the third variable-volume reservoir from the fluid conduit, while allowing fluid communication between the third variable-volume reservoir and the sample port.

In at least some embodiments, one or more of the first, second and third variable-volume reservoirs can include a pressure-balance port in fluid communication with the flowline. Such a pressure balance port enables volume variation of the respective variable-volume reservoir having its open end exposed to a flowline pressure without having to overcome flowline pressure.

In another aspect, at least one embodiment described herein provides a process for analyzing a fluid sample within a wellbore. The process includes varying a volume of a first reservoir pre-charged with a reactant and having an open end exposed to a fluid conduit. A volume of a second reservoir is also varied, the second reservoir similarly having an open end exposed to the fluid conduit. A region of the fluid conduit between open ends of the first and second reservoirs is exposed to a high pressure flow of high-pressure fluids withdrawn from a subterranean formation. A fluid sample is extracted from the flow of high-pressure fluids responsive to relative variations of volumes of the first and second reservoirs.

In at least some embodiments, the process includes initially decreasing the volume of the first reservoir and equivalently increasing the volume of the second reservoir for a predetermined time, thereby pre-loading the fluid conduit with at least a portion of the reagent. The act of selectively mixing together at least a portion of the reactant and at least a portion of the extracted fluid sample can be responsive to relative variations of volumes of the first and second reservoirs. Selectively mixing can include agitating a combination of at least a portion of the reactant and at least a portion of the extracted fluid sample. The process can further include detecting a physical of the reagent-sample mixture, for example, detecting at least one of an optical property, an electrical property and a chemical property of the reagent-sample mixture.

In at least some embodiments, the process further includes collecting a waste portion of the reagent-sample mixture, thereby avoiding exposure to a local environment. Collecting the reagent-sample mixture can include, for example, injecting at least a portion of the reagent-sample mixture into the flow of high-pressure fluids.

In yet another aspect, at least one embodiment described herein provides a process for analyzing a fluid sample within a wellbore. The process includes providing a reactant within a wellbore. The temperature and pressure within the wellbore are each substantially greater than corresponding temperature and pressure at a surface of the wellbore. At least a portion of the reactant is mixed with a sample of formation fluids, within the wellbore, according to a volumetric ratio. The resulting mixture has a physical property that is responsive to the volumetric ratio. The physical property of the mixture is determined. In at least some embodiments, the determined physical property is indicative of a volume ration of the mixture.

In at least some embodiments in which the reactant is provided within solution at a known concentration, the process further includes repeatedly mixing increasing portions of the reactant solution with the sample of formation fluids. The sampled formation fluids have an unknown concentration of an analyte. A substantial change in the physical property of the resulting mixture is detected. A concentration of the analyte present within the sample of formation fluids can be determined responsive to at least one of the volumetric ratio and the detected physical property at which the substantial change in the physical property of the resulting mixture was observed.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DESCRIPTION OF THE PREFERRED EMBODIMENTS

Figure 1:
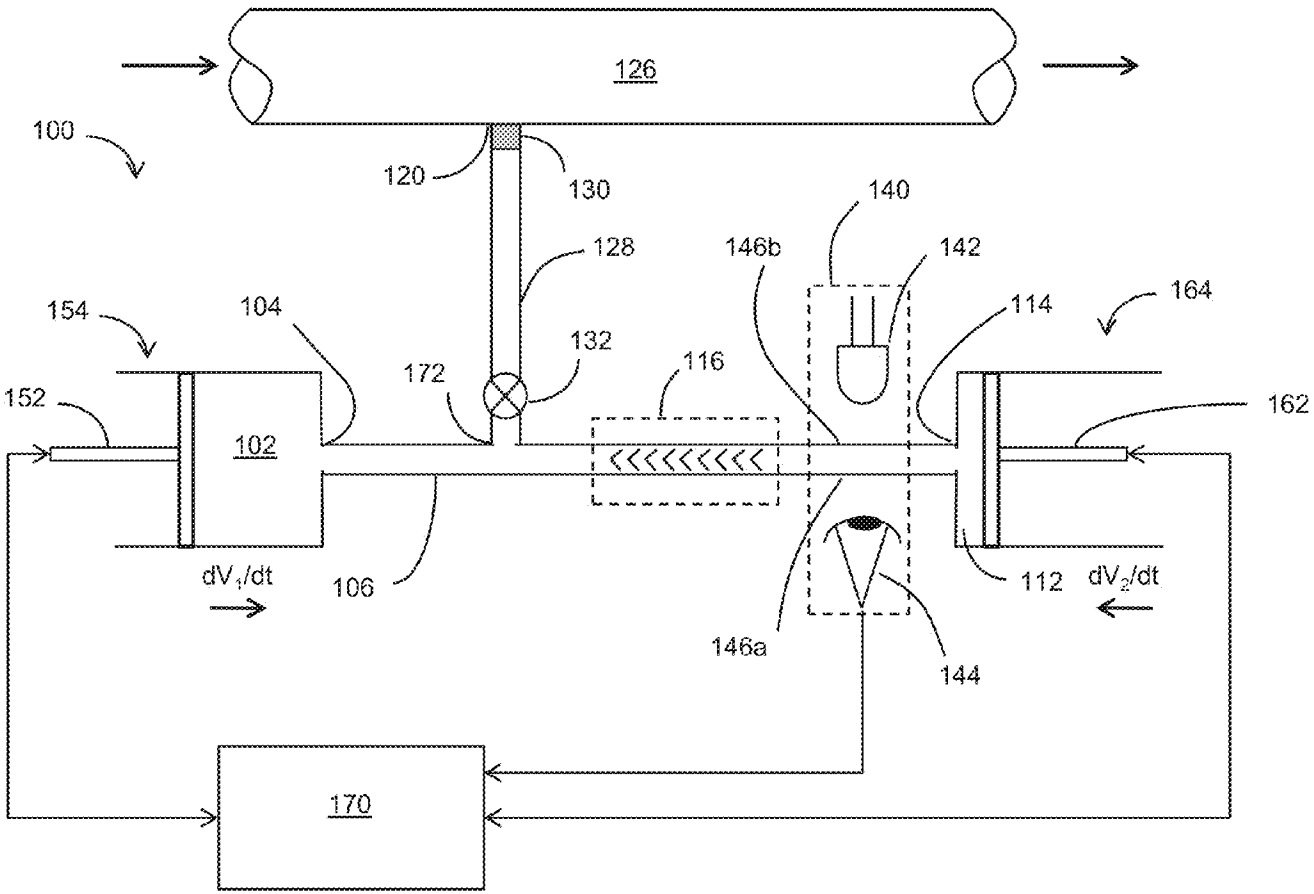
FIG. 1 shows a block diagram of an embodiment of a device for mixing a sample with a reagent under downhole conditions.

In the following detailed description of the preferred embodiments, reference is made to accompanying drawings, which form a part thereof, and within which are shown by way of illustration, specific embodiments, by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the case of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in that how the several forms of the present invention may be embodied in practice. Further, like reference numbers and designations in the various drawings indicate like elements.

Devices and processes for mixing a fluid sample containing an analyte solution with a reagent under downhole conditions are presented. Such mixing of an analyte solution with a reagent may be accomplished, for example, to detect one or more of the presence and concentration of an analyte within the fluid sample. In at least some embodiments, a mixing ratio of the reagent and analyte solution can be established to a desired accuracy. Such approaches can be used, for example, (i) to simple-mix at least two fluids and interrogate the mixture for chemical analysis, (ii) to accomplish a titration, or (iii) to perform flow-injection analysis. In at least some embodiments, such approaches include the possibility for self-calibration of a system under downhole conditions.

It should be appreciated that temperatures and pressures at downhole locations within a wellbore differ from temperatures and pressures at a surface of the wellbore. For wellbore depths at which formation fluids might be extracted, such temperatures and pressures can be substantially greater that at a surface. For example, downhole temperatures can range from up to 100° C., 150° C., or 200° C. and higher. Likewise, downhole pressures can range from up to 500 psi, 1,000 psi, 10,000 psi, and even 30,000 psi and higher. It is often desirable when evaluating fluid samples obtained from subterranean formations, to conduct such evaluations upon sampled fluids in a state most closely resembling the state at which the fluids exist within the subterranean formation. At least one such approach includes evaluating sampled fluids at a subterranean location (i.e., downhole) as close as possible to a location at which the fluids were sampled. At the very least, the state of matter of the sampled fluid (i.e., solid, liquid, gas) would most closely resemble the state of matter of the fluids within the formation (e.g., within a hydrocarbon reserve).

By way of example, an embodiment of a system 100 for mixing a fluid sample with a reagent under downhole conditions is shown in FIG. 1. The system 100 consists of a first fluid reservoir 102 having an open end 104 in fluid communication with a fluid conduit 106. A second fluid reservoir 112 is also provided having an open end 114 in fluid communication with the fluid conduit 106. A fluid mixer 116 is serially disposed along the fluid conduit 106 at a location between open ends 104, 114 of the first and second fluid reservoirs 102, 112. The system 100 also includes a sample port 120 configured to receive a sample of fluids from a high-pressure flowline 126. In at least some embodiments, flowing within the high-pressure flowline 126 are fluids withdrawn from a subterranean formation, such as a hydrocarbon reserve. As such, the sampled fluids may contain combinations of one or more of liquids, gasses, and suspended solids.

The sample port 120 is also in fluid communication with the fluid conduit 106 at a location between the open end 104 of the first reservoir 102 and the fluid mixer 116. A sampling fluid conduit 128 is disposed between the sample port 120 and the fluid conduit 106, allowing for a flow of fluids therebetween. In at least some embodiments, the sampling fluid conduit 128 is configured to be as short as possible to reduce flow resistance and dead volume. One or more filters 130 can be provided to filter fluid flowing from the flowline 126, through the sample port 120 and toward the fluid conduit 106. Such a filter 130 can be used to filter out particles from the fluid sample that might otherwise clog the system or cause an off-set in the measurement.

In at least some embodiments a valve 132 is provided between the sample port 120 and the fluid conduit 106. For example, an isolation valve 132 is located along the sampling fluid conduit 128. The isolation valve 132 is configured to selectively allow or otherwise block a flow of fluids between the sample port 120 and the fluid conduit 106. So positioned, the isolation valve 132 does not interfere with a flow of fluids between the first fluid reservoir 102, the second fluid reservoir 112 and the fluid mixer 116. The valve 132 is optional but can be included, for example, to prevent leakage of the reagent (e.g., stored in one or more if the first and second reservoirs 102, 112) during transportation and while placing the system 100 into a wellbore. The closed valve 132 can also be used to prevent exposure of the rest of the system 100 to sudden pressure drops and pressure spikes as may be encountered within the flowline 126 during periods of operation.

The system 100 can be configured with a fluid interrogator 140 configured to determine a physical property of a fluid. In the illustrative embodiment, the fluid interrogator 140 is positioned to interrogate a fluid at a location between the fluid mixer 116 and the second fluid reservoir 112. One such fluid interrogator 140 is configured to determine an optical property of a fluid, such as its optical density, also referred to as absorbance. Absorbance is a ratio of a radiant flux absorbed by a body (i.e., fluid) to that incident upon it. Absorption spectroscopy refers to spectroscopic techniques that measure the absorption of radiation, as a function of frequency or wavelength, due to its interaction with a sample. For example, absorption spectroscopy can be employed as an analytical chemistry tool to determine the presence of a particular substance in a sample and, in many cases, to quantify the amount of the substance present.

The example interrogator 140 includes a light source 142 and a light detector 144 (a wavelength dependent detector for spectroscopic applications). At least a portion of the fluid to be interrogated is passed between the light source 142 and the light detector 144. At least a portion of the illumination provided by the light source 142 is directed towards the detector 144, passing through the fluid. In at least some embodiments, windows **146*a*,146*b* are suitably positioned along the fluid conduit 106** to allow such optical interrogation of fluid flowing therewithin. A large scale example of such a tool configured for use downhole within a wellbore include the Live Fluids Analyzer (LFA) or Compositional Fluid Analyzer (CFA) modules of the Modular Formation Dynamics Tester (MDT), a tool suite available in the commercial services provided by Schlumberger, Sugar Land, Tex.

It is understood that in at least some embodiments, the optical interrogator 140 can be replaced or otherwise supplemented by other fluid interrogators. Examples of such interrogators include electrochemical detectors, for example, electrically interrogating the fluid to determine an electrical response (e.g., conductivity as an indication of salinity); piezoelectric interrogators, for example, determining a frequency shift imparted by the fluid; and magnetic interrogators, for example, determining a magnetic property, such as a change in magnetic susceptibility of the fluid.

In operation, the first fluid reservoir 102, for example, can be pre-loaded with a reactant (e.g., reagent). The reagent can be selected according to the particular analyte solution being analyzed, such that a mixture of the reagent and a fluid sample of the analyte solution obtained from the flowline 126 will produce a detectable change in a physical property of the fluid that can be detected by the one or more fluid interrogators 140.

In the illustrative embodiment, each of the first and second fluid reservoirs 102, 112 are variable-volume reservoirs. For example, each of the fluid reservoirs 102, 112 can include a respective repositionable plunger 152, 162. A repositioning of a plunger 152, 162 within either of the reservoirs 102, 112 changes a volume $V_1$, $V_2$ of the respective reservoir 102, 112 in a corresponding manner. Thus, the two plungers 152, 162 of the illustrative embodiment can be used to manipulate one or more fluids flowing within the fluid conduit 106. A first pump 154, for example, can be used to reposition the first plunger 152, e.g., advancing it toward the open end 104 to effectively push reagent from the reservoir 102 into the fluid conduit 106. Likewise, a second pump 164 can be used to urge the second plunger 162 away from the open end 114 to effectively draw fluid from the fluid conduit 106 into the second reservoir 112. In a like manner, various combinations of repositioning the first and second plungers 152, 162 can be used to regulate a ratio of reagent and reservoir fluids within the fluid conduit 106 and particularly within a region of the fluid conduit 106 exposed to the fluid interrogator 140.

The second plunger 162 can be used to pull one or more of reservoir fluids from the flowline 126 and a reagent from the first reservoir 102 through the fluid conduit 106. The first plunger 152 of the first reservoir 102 containing the reagent can be advanced to push the reagent out of its reservoir 102 through the fluid conduit 106. In situations in which only the second plunger 162 is moving, reservoir fluids can selectively be drawn from the flowline 126 through sample port 120, presuming the valve 132 is open, and into the fluid conduit 106. Alternatively, by pushing reagent from the first reservoir 102 using the first plunger 152, while simultaneously drawing fluid into the second reservoir 112 using the second plunger 162 to achieve an equivalent change in volume between the two reservoirs 102, 112, a controlled flow of fluids can be achieved that selectively pulls reagent into the fluid channel, without drawing sample fluid into the fluid conduit 106. This result can be achieved even though a valve 132, if present, is open.

More particularly, when the first and second plungers 152 and 162 are moved to provide an equivalent rate of change of volumes of each respective reservoir 102, 112, but in an opposite sense (i.e., $(dV_1/dt)=(-dV_2/dt)$), fluid from the sampling fluid conduit 128 is prevented from entering the fluid conduit, despite the valve 132 being open. Thus, it is possible to pull only reagent through the fluid conduit 106, despite the fluid conduit 106 being exposed to a pressurized flow of fluids from the flowline 126. A slightly lower rate of change of the first reservoir's volume attained by repositioning of the first plunger 152 (i.e., the reagent plunger) than for the second plunger 162 (i.e., $|dV_1/dt|<|-dV_2/dt|$) results in a controlled flow of reservoir fluids from the sampling fluid conduit 128 and into the fluid conduit 106. By controlling the relative rates of change of volumes of the two reservoirs 102, 112 in such a manner, a known mixing ratio can be obtained within the fluid conduit 106. This mixing ratio can be varied by varying the rate of change of volume of the first reservoir 102, for example, to extend the operating range of the sensor.

In at least some embodiments, a controller 170 is provided to control at least operation of the first and second pumps 154, 164. Pumps, such as syringe pumps, can be calibrated, such that a position of its plunger (x) can be used to determine a volume (V) of an associated reservoir. Likewise, a rate of change plunger position (dx/dt) can be used to determine a rate of change of reservoir volume (dV/dt). Such a processor 170 can be in electrical communication with one or more of the pumps 154, 164 to cause changes in volume of the respective reservoirs 102, 112. Alternatively or in addition, the controller 170 can be in electrical communication with the fluid interrogator 140, to receive status as to any interrogated physical properties of the fluid. Such a processor can include one or more microprocessors, for example, executing a set of pre-programmed instructions. Such pre-programmed instructions can be prepared to conduct one or more analytical protocols. It is conceivable that in at least some embodiments, the controller 170 can be used to control operation of the valve 132. In at least some embodiments, the controller 170 includes a timing reference usable to control one or more if timing, as duration and sequence, and rates fluid transfers.

In at least some embodiments, the system 100 (e.g., the controller 170) includes a user interface and/or a data recorder configured to record or otherwise document analytical results. One or more of the controller, user interface and data recorder can be located downhole, at a surface location, for example, being coupled to various elements of the system 100 through telemetry, or in a distributed configuration with some elements located downhole and others at one or more surface locations. It is also envisioned that some of the surface components can be located in the immediate vicinity of the wellbore, while other surface components can located remotely. Communication between any such remote surface components can be accomplished with any suitable means, such as telecommunications and through the Internet.

With each of the sampled reservoir fluids and reagent allowed to flow separately, remote (e.g., downhole) calibration of the system 100 can be achieved. Calibration of the system 100 in such a manner allows for correction of any of the interrogated physical properties, such as optical absorption by the reservoir fluids or the reagent. For example, during calibration, a predetermined ratio of fluids (e.g., pure reagent) can be advanced through the fluid conduit 106 sufficiently to be interrogated by the interrogator 140. Physical properties determined by the fluid interrogator 140 can be compared, for example by the controller 170, to expected or otherwise premeasured results under similar circumstances. Any variations between measurements obtained by the fluid interrogator 140 and the expected results can be used to characterize one or more elements of the system 100 and/or the fluids used during operation of the system. Calibration can be used, for example, to detect and/or correct for fouling of the optical windows **146*a*, 146*b* in case more than one measurement is made. Alternatively or in addition, calibration can be used to detect short term and long term effects, such as aging of the light source 142**. A calibration factor can be determined based on variations from a baseline to offset or otherwise calibrate measurement results.

A greater precision, for example, in identifying the presence and/or concentration of analyte solution is expected when a volumetric mixing ratio of the fluid sample (analyte solution) and the reagent is known with a high degree of specificity. Such results can be achieved, for example by using very accurate volume changes, as may be obtained by very accurate plunger movement. Another method includes the addition of an insensitive color agent to the reagent. The color agent is chosen to absorb at a different wavelength than the analyte dye combination. A good example of such a color agent is commercially available food color.

The fluid mixer 116 can be a passive mixer, such as a herring bone structure provided in fluid contact with a flow of fluid through the conduit 106. The herring bone or similar structure creates turbulence in a flowing fluid that results in a mixing action, for example, when the flow includes two or more constituents. It is understood that any type of passive mixing can be used, for example a serpentine line. Alternatively or in addition, the fluid mixer 116 can include an active mixer, such as a piezoelectric device, a mechanical agitator, or some combination of both.

The first reservoir 102 is sized to accommodate at least a sufficient volume of reagent to conducted an intended analysis of a sampled fluid. Likewise, the second reservoir 112 is sized sufficiently to accommodate at least that volume of sampled fluid and reagent used in an intended analysis. In at least some embodiments, one or more of the reservoirs 102, 112 and available displacement of the plungers 152, 162 are chosen to be large enough such that more than one measurement can be made.

It generally desirable to avoid exposure of a local environment to the reagent, including mixtures of sampled fluids and the reagent. In the illustrative embodiment, the first and second reservoirs 102, 112 are isolated from the surrounding environment, other than through the sample port 120. Operation of one or more of the plungers 142, 162 and isolation valve 132, when present, can be controlled to prevent a flow of fluid from either of the reservoirs 102, 112, the fluid conduit 106 and the fluid mixer 116 through the sample port 120 toward the flowline 126. Additionally, the second reservoir 112 and plunger 162 can be sized sufficiently to collect all fluids processed by the system 100, thereby preventing exposure of the environment to any chemicals used during the analysis. In at least some embodiments, the second plunger 162 is actuated to draw one or more of the reagent and sampled fluid through the mixer 116 and into an interrogation region of the fluid interrogator 140, while at the same time, collecting waste.

One or more components of the system 100 can be implemented according to techniques and components generally understood to be microfluidic, minifluidic, or some combination of microfluidic and minifluidic. A microfluidic system is generally understood to consists of fluid channels on the order of a few hundred micrometers, or perhaps less. In microfluidic systems the associated volumes will be relatively small allowing smaller plungers 152, 162 and pumps 154, 164 with relatively small motors. A disadvantage of a microfluidic systems or system components is that they are more sensitive to fouling and that flow resistance and viscosity within the comparatively small fluid conduits can affect the mixing ratio. Reference to "minifluidic" as used herein refers to fluid conduits or channels having diameters from about 0.5 millimeter up to about 2 millimeters. Such minifluidic systems will generally require larger plungers 152, 162 and pumps 154, 164 with relatively bulkier motors. A benefit, however, will be less sensitivity to clogging and flow resistance.

Continuous Mixing:

Any of the various fluid analysis systems, such as the system 100 illustrated in FIG. 1, are capable of being operated in various operational modes. For example, a first operation mode is referred to herein as continuous mixing. Continuous in relation to the continuous mixing mode suggests that formation fluid sampled from the high-pressure flowline 126 and the reagent are flowing within the system 100 for a sufficient duration to allow the system 100 to reach a state of equilibrium during which a stable signal can be obtained from the fluid interrogator 140. For example, depending upon such features as flow rates, volumes and dead space, the time required to reach equilibrium may take up to a several minutes or more.

Continuous mixing mode can be used in various ways during chemical analysis of fluid samples in a wellbore environment (i.e., downhole). For example, continuous mixing can be used for downhole calibration of the system 100. Downhole calibration can be accomplished to check for coloration of the reagent or aging of the light source and the detector or any other effect that might cause a change in the baseline. Even coloration of the fluids in the flowline can be detected by using a second measurement with only sampled formation fluid. The mixing ratio can be adjusted according to such calibration measurements to optimize fluid interrogation results and thereby enlarge the measurement range.

It is generally understood that a single measurement can be sufficient for determining concentration of analyte, such as sulfide, within a fluid sample according to the mixing and interrogation techniques described herein. However, it is also appreciated that repeating such measurements at various mixing ratios can be used to improve accuracy. For example, an average of such repeated measurements can be used to calculate a sulfide concentration. Alternatively or in addition, an estimate, such as a curve fitting (e.g., best linear fit) can be calculated through the measurements points. The latter method offers an advantage in that any offset in the repeated measurements is corrected.

Figure 2:
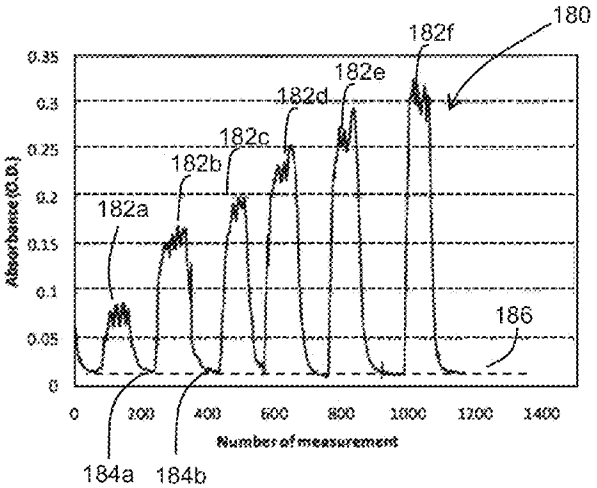
FIG. 2 shows optical absorbance measured for an example mixture obtained at various mixing ratios.

FIG. 2 shows example absorbance measured obtained using a fluid interrogator configured for sulfide detection at room temperature and atmospheric pressure. An optical interrogator was used to detect an absorbance of the fluid sample-reagent mixture, having a peak absorbance at about 400 nm. The absorbance 180 is plotted against the number of measurements. A sulfide was added in the form of sodium sulfide and reacted with cadmium, which was provided in a 2% poly(acetic acid) (PAA) water solution. The mixing ratio was varied to obtain measurements at multiple mixing ratios 182*a*, 182*b*, 182*c*, 182*d*, 182*e*, 182*f* (generally 182) of the same sample. Each peak region 182 (e.g., at approximately 150, 300, 500, 650, 850 and 1,050 measurements) relates to repeated interrogations of a respective mixture. As the mixing ratio is increased with successive samples, the respective absorbance increases as shown. Each peak region 182 also represents multiple measurement results (e.g., 30-40 measurements) at substantially the same mixing ratio.

Valleys or troughs 184*a*, 184*b* (generally 184) residing between the peak regions correspond to measurements taken with only the reagent flowing. As can be observed in the illustrative example, each of the troughs 184 has approximately the same relatively low absorbance. A dashed line 186 drawn through the troughs indicates a baseline measurement of the reagent only. As illustrated, the baseline 186 is substantially horizontal, suggesting little or no change occurred for repeated measurements over the course of the experiment. In some situations, however, one or more factors may result in a change, such as coloration of the reagent dye, fouling of the windows through which the fluid is interrogated, or performance variations in the fluid interrogator 140 (FIG. 1). Such variations, when present and detected according to such measurements, result in a shift of the baseline trough measurements. The amount of such variations, with all else being equal, can be used to offset absorbance measurements 182 during those periods when a mixture is detected, to otherwise account for variations and in effect calibrate the measurement.

Figure 3:
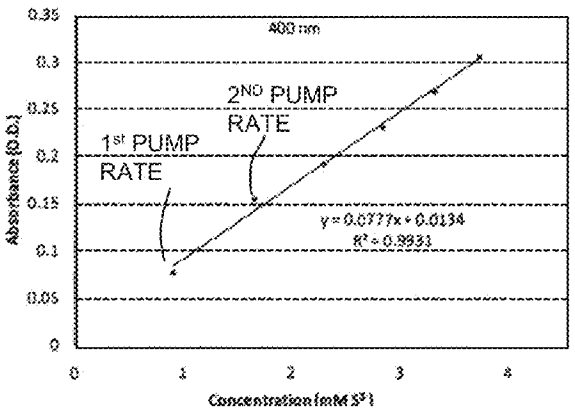
FIG. 3 shows an average of the optical absorbance of FIG. 2 versus theoretical mixture concentration.

Within each region in which a mixture is detected 182, an average absorption can be calculated from the multiple (e.g., 30-40) measurements associated with each peak region, for example, by taking an average of the repeated measurements. Average absorption values obtained in such a manner for the results of FIG. 2 are illustrated in FIG. 3. The average absorption for each peak region and its associated pump rate is plotted on coordinate axes, versus a theoretical sulfide concentration. The theoretical concentration can be determined, for example, by knowing the precise volumes of reagent and analyte solution, then performing a volumetric analysis of the underlying chemical reaction between reagent and analyte. A linear result is obtained, as shown and further indicated by a straight line fitted to the plotted average values. Thus, when accomplishing the chemical reaction within such a volumetric system as shown and describe herein, the physical property of absorbance can be used as an indicator of analyte concentration. For example, a straight line relationship can be used to predict concentrations at different measured absorbances.

The above results were obtained using a plastic chip with mixer connected to the optics and the plungers by rubber tubes. It is conceivable, that the pulling of fluids through such a fluid analysis system will result in a pressure drop, which might result in the formation of gas bubbles. Components in the fluid, e.g., methane in oil or carbon dioxide in water, might cause the formation of gas bubbles. To prevent such formation of gas bubbles, the pressure drop imparted during operation of the pumps 154, 164 should be minimized. Such desirable results can be achieved by reducing the flow rate and/or reducing the flow resistance. For example, the flow resistance can be reduced by using shorter path lengths and/or relatively wider channels.

Titration:

Another operating mode of the various fluid analysis systems described herein is titration. Titration is generally understood to allow for the determination of an unknown concentration of an analyte solution by the addition of a reagent solution with a known concentration until an endpoint is reached. The endpoint can be indicated by any detectable means, such as a color change, precipitation or otherwise observable change. An initial concentration of the unknown sample of analyte solution can be calculated from the amounts (i.e., volumes) of sample and reagent present at the endpoint. Titrations are used for the determination of many analytes, including alkalinity, chloride concentration and barium concentration. An understanding of the underlying chemical reaction or a predetermined relationship between the measured physical property, together with the determined mixing ratio can be used to determine a concentration of the analyte.

In a microfluidic titration, a mixing ratio is varied to determine an endpoint. The mixing ratio can be varied in a stepwise change, continuously, or some combination of stepwise and continuous. A stepwise variation of the mixing ratio is comparable to conducting several measurements for which the mixing ratio is different at every measurement. It is understood that measurement of any particular mixing ration can be repeated and, for example, averaged as an indicator of the associated mixing ratio. Just as in a regular titration, the endpoint can be determined by the achievement of an endpoint indicator, such as a color change, precipitation or other detectable property (e.g., changes in pH, salinity).

The volumetric step size used in such an approach should be relatively small, as the endpoint is typically observed by a sudden and dramatic change in the observed physical property, generally occurring between two adjacent steps. In at least some embodiments, the mixture associated with the endpoint is considered as an approximation of the mixture ratio at which the endpoint indicator is observed. In at least some other embodiments, the mixture associated with the endpoint is interpolated between one or more observations before and after the endpoint indicator is observed. Alternatively or in addition, relatively course step size can be used to initially isolate the endpoint as occurring between two adjacent steps. The process then can be repeated between the identified steps at a second, finer step size to more precisely locate a mixture associated with the endpoint. The process can be repeated as necessary for even finer step sizes.

A continuously varying mixing ratio is generally more difficult to handle. The flow rates need to be known very accurately, so that the time of flight between the point where both fluids come together (e.g., a junction 172 (FIG. 1)) and the fluid interrogator 140 are known.

Another titration approach relies upon dye concentration as an indicator of the mixing ratio. This approach can be relatively insensitive in that dye that is added to the reagent or the dye that signals the endpoint. The latter case, however, requires a dye that shows optical absorbance both before and after the endpoint is reached. Many pH sensitive dyes show this behavior.

Figure 4:
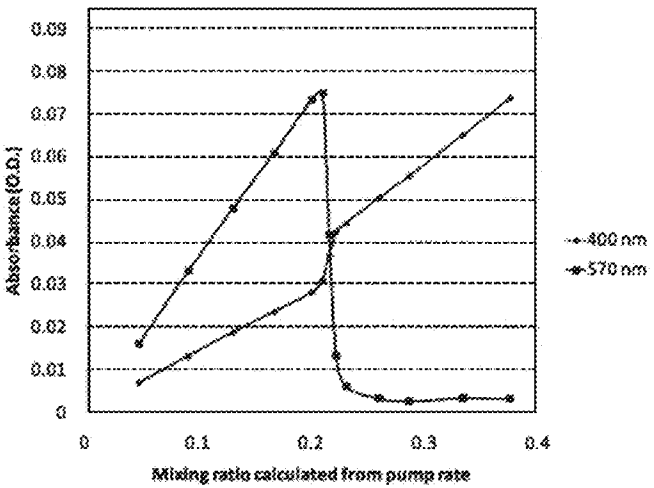
FIG. 4 shows optical absorbance at alkaline peak and acid peak for an example mixture of bromocresol green as function of the mixing ratio.

Referring next to FIG. 4, the results of an experiment to determine the alkalinity of a solution at room temperature and atmospheric pressure are shown. As an example, a 5 mM NaOH solution is titrated with 0.0182 N sulfuric acid. The acid contains 0.0952 mM of bromocresol green, a pH sensitive dye. The molar absorption coefficients of the dye were determined before the experiment, such that the dye can be identified in an absorbance spectrum of the mixture obtained by the optical interrogator. As the mixing ratio of the reagent and analyte solution are varied and tracked according to pump rates (or volumetric changes), the absorbance is measured for the acid and alkaline. The mixture is varied during a titration, until a sudden change in the absorbance of one or more of the acid and alkaline is observed at a mixing ratio of about 0.225. The stepwise increase in mixing ratio changes was continued as shown. Such a process can be accomplished within a wellbore environment, for example, using any of the fluid analysis systems described herein.

Figure 5:
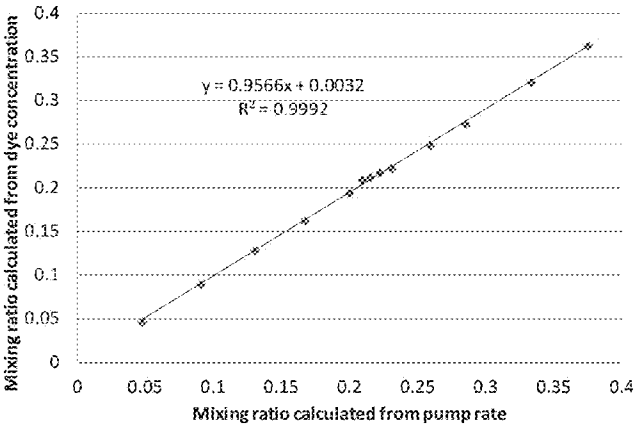
FIG. 5 shows mixing ration determined from dye concentration versus mixing ratio determined from pump rate.

Beneficially, the mixing ratio between the acid (400 nm) and alkaline (570 nm) can be determinable from the dye concentration. Such a mixing ratio can be compared to a mixing ratio determined from the relative pump rates. In the illustrative example, the mixing ratio is linear and in good agreement with the mixing ratio as determined from the pump rate as illustrated in FIG. 5. FIG. 5 illustrates the mixing ratio calculated from optical absorbance versus the dye concentration calculated from the pump rate.

Figure 6:
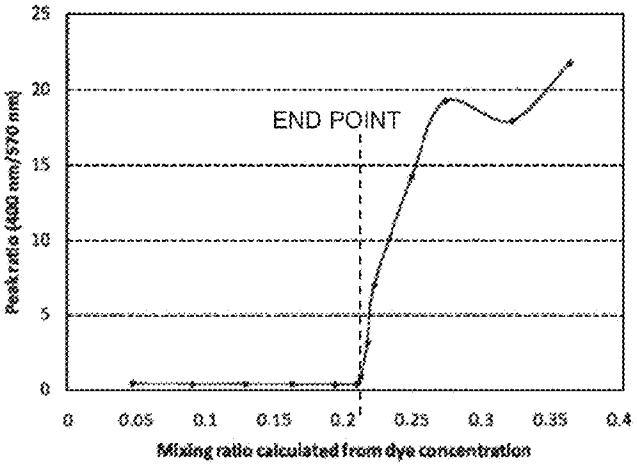
FIG. 6 shows peak ratio (acid peak/alkaline peak) of an example mixture as a function of dye-based mixing ratio.

FIG. 6 shows a peak ratio determined as a ration of acid peak to alkaline peak (acid peak/alkaline peak) versus the mixing ratio as determined from the pump ratio. Each of the acid and alkaline peaks can be determined from the results in FIG. 4, and then formulated as the ratio plotted in FIG. 5. It can be seen clearly how the ratio of the acid peak (400 nm) over the alkaline peak (570 nm) changes as function of the mixing ratio. The theoretical endpoint is calculated to be at a mixing ratio of about 0.220. This endpoint is the point at which the peak ratio starts to rise, showing the dye concentration can be a valid indicator for the determination of the mixing ratio.

Flow Injection Analysis:

Another operating mode of the various fluid analysis systems described herein is referred to as "flow injection analysis." In flow injection analysis, a small sample of a solution (e.g., sampled formation fluid) is "injected" into a flowing reagent. In some embodiments, the reagent can be injected into a flowing sample. Referring to the system 100 illustrated in FIG. 1, such injection flows can be achieved by having the first plunger 152 advancing at a first rate ($dx_1/dt$) to reduce the volume of the first reservoir 102 according to a first volumetric rate of change ($dV_1/dt$). The second plunger 162 can be withdrawn at a respective rate ($dx_2/dt$), to increase the volume of the second reservoir 112 according to a respective volumetric rate of change ($dV_2/dt$). With valve 132 open, the relative volumetric rates of change can be used to selectively and independently control the relative flows of reagent (from the first reservoir 102) and sampled formation fluid (from the flowline 126) as described above.

For example, the plungers 152, 162 can be advanced/withdrawn to achieve equivalent volumetric rates of change ($-dV_1/d\,t=dV_2/dt$). Assuming that formation fluid flowing in the flowline 126 is exposed to the fluid conduit 106 through the sampling fluid conduit 128 (i.e., valve 132 open), a balance in pressures at the junction 172 will result in a substantially pure flow of reagent past the fluid interrogator 140. Sampled formation fluid from the flowline 126 can be introduced and combined with the reagent by change the relative volumetric rates of change. For example, by selectively withdrawing the second plunger 162 for a short moment at a faster rate (increasing $dx_2/dt$), volumetric rate of change ($dV_2/dt$) of the second reservoir 112 is increased. The difference in change of volumes between the first and second reservoirs 102, 112 (e.g., the second reservoir expanding faster than the first reservoir is collapsing) is taken up by a flow of sampled formation fluids from the sampling fluid conduit 128. The result is a mixture of reagent and fluid sample drawn past the fluid interrogator 140.

The resulting variation in mixture, e.g., from pure reagent to a mixture of reagent and sampled formation fluid, results in a corresponding variation in the detected physical property of the fluid. Using an optical fluid interrogator (e.g., spectrometer), a variation in absorbance of the reagent/mixture can be observed. When tracking an absorbance peak (a corresponding wavelength) indicative of a selective analyte in the sampled formation fluid, a short peak in absorbance versus time (sample number) is detected by the detector 144. The change in absorbance resulting in such a peak corresponds to the mixture of sampled fluid and reagent passing an interrogation zone of the optical fluid interrogator 140. There would likely some a delay between variation of pump rates and detection of absorbance changes resulting from a fluid transit time between the junction 172 at which the sampled fluid is introduced to the reagent and the interrogation zone. The peak variation can be analyzed, for example, according to a peak height (i.e., maximum absorbance) or by integrating the area under the absorbance peak.

At least one advantage of flow injection analysis is that a continuous baseline measurement is naturally provided by the flow of substantially pure reagent occurring at times (samples) in between periods in which a mixture of reagent and analyte is detected. Such a baseline can be used to detect variations in one or more of the system 100 and the reagent, and in at least some instances, used to calibrate measurements to account for any offsets observed in the baseline. Furthermore, flow injection analysis is relatively fast and uses a limited amount of fluid sample, such as the relatively small amounts injected during periods of mixing. Flow injection analysis alleviates the need to use sufficient sample and reagent to reach an endpoint or equilibrium as may be done in continuous mixing mode. Instead, small sample volumes can be used, provided they result in detectable variations of the interrogated property (e.g., absorbance). The ability to analyze sampled formation fluids by using only small volumes is particularly useful for situations in which the occurrence of precipitation is possible, as with the reaction of sulfide with metal ions.

Figure 7:
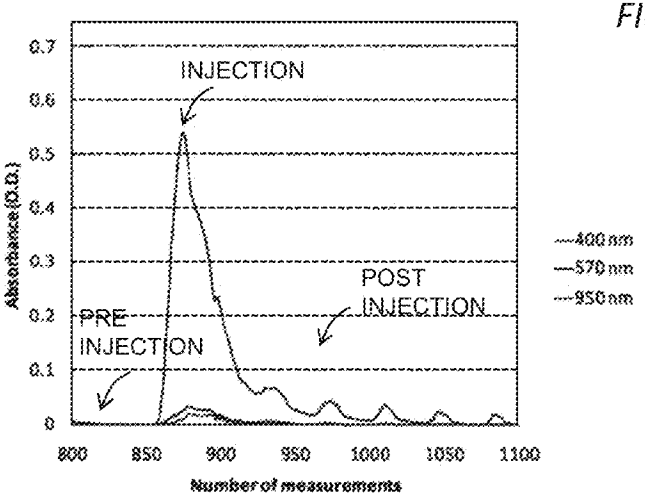
FIG. 7 shows measured absorbance obtained after injection by pulling on plunger at a higher speed than pushing another plunger.

In an example, two syringe pumps (154, 164), a snake mixer (116) and an optical cell (interrogator 140) were used to mimic the system 100 described in relation to FIG. 1. One syringe 102 was filled with Cd-PAA-water solution (e.g., reagent) and configured to push; whereas, the other syringe 112 was configured to pull. The flowline (126) was mimicked by an Erlenmeyer flask filled with a sodium sulfide solution (e.g., sampled formation fluid). The pumps 154, 164 were configured to push/pull at a rate of about 0.5 ml/min. The pulling rate was raised to about 0.7 ml/min for about 15 seconds and then reduced once again to about 0.5 ml/min. The higher pulling rate allowed sulfide from the Erlenmeyer flask to be "injected" in the reagent flow from the first syringe pump 154. An optical response measured by the optical cell was recorded using this configuration and is shown in FIG. 7. The figure shows a typical flow-injection-analysis response, in reference to the preinjection region followed by a substantial peak corresponding to the injection, followed by a trailing off of the peak during a post injection period. The peak absorbance occurs after a slight delay with respect to the timing of the injection, due at least in part to a time of flight between the reservoirs 102, 112 and the interrogator 140. The measured absorbance includes several additional minor peaks in the so-called post injection period. These peaks resulted from an artifact of the system configuration. Namely, the minor peaks were due to unintended, inhomogeneous pushing and pulling of the syringe pumps 154, 164. The minor variations between the relative volumetric rates of change of the two syringe pumps 154, 164, which resulted in small amounts of sulfide to enter the reagent flow during non-injection periods. The unintended sulfide resulted in minor detectable variations. This effect is generally more profound for smaller and/or shorter injection volumes. Such unintended consequences can be avoided by using more precise pumps 154, 164. It should be noted, however, that the relatively minor peaks can be distinguished, for example, by establishing a threshold, e.g., an absorbance of greater than 0.1 being indicative of an injection.

Figure 8:
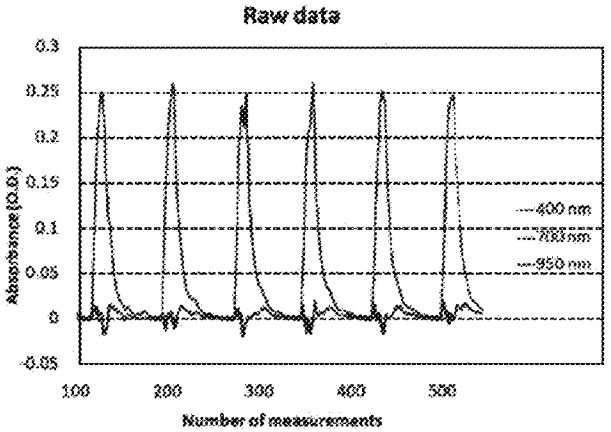
FIG. 8 shows raw absorption data obtained for an example mixture after repeated injections of a sodium sulfide solution
Figure 9:
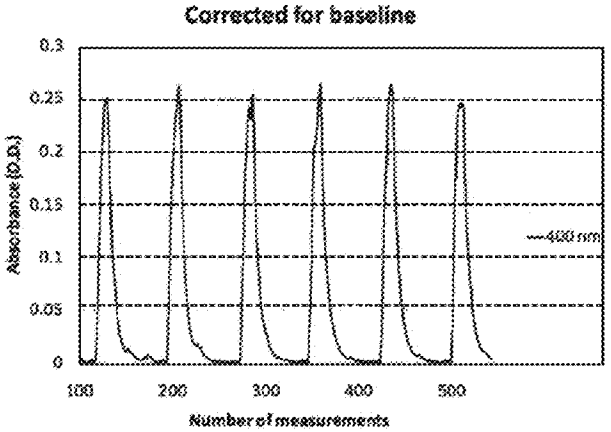
FIG. 9 shows corrected absorption response for an example mixture obtained according to five injections of a sodium sulfide solution into a cadmium containing reagent.

FIGS. 8 to 13 show measured absorbance results for sulfide detection obtained at room temperature and atmospheric pressure. The experimental configuration used in obtaining the results portrayed in FIGS. 8-13 included two syringes pushing with an open outlet. Using any of the systems and techniques described herein, similar results can be achieved by the mixing together of reagent and sampled formation fluids followed by interrogation of the mixture within a wellbore. To simulate the injection two syringe pumps were used both pushing the fluids (reagent and sulfide solution) through the system. The sulfide reacts with cadmium (e.g., 2 mM $CdSO_4$) in a 1.75% PAA water solution. FIG. 8 shows the raw data of repeated injections of 100 μl of 10 mM into a sodium sulfide solution ($Na_2S$). The 100 μl sodium sulfide solution is injected at rate of 600 μl/min. Each injection is observable by a substantial increase in absorbance of the resulting mixture at 400 nm. The flow rate of the reagent is about 1 ml/min. A reference absorbance of the mixture obtained at 950 nm is also shown in the raw data of FIG. 8. A corrected absorbance at 400 nm can be obtained by subtracting the absorbance at 950 nm from the absorbance at 400 nm. The result of such a correction applied to the data of FIG. 8 is shown in FIG. 9.

In at least some embodiments, a maximum absorbance can be calculated, for example, by subtracting the average of the last ten measurements before the injection to correct for any baseline offset. In the illustrative example, an average absorbance of the six measurements is about 0.255 with a standard deviation of 0.008, thus showing good repeatability.

Figure 10:
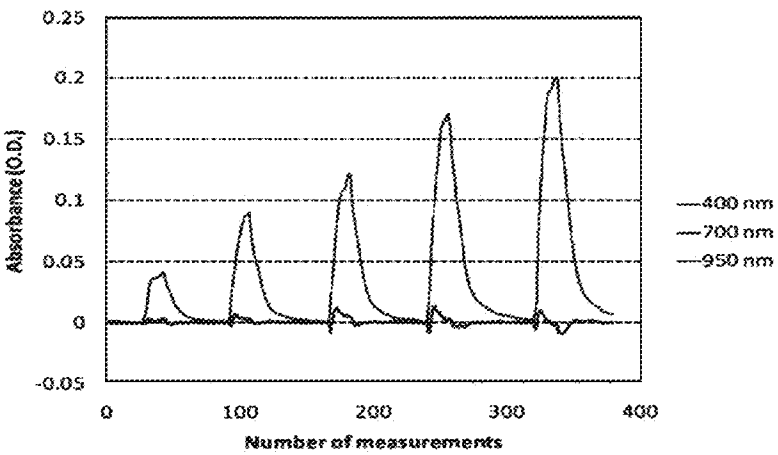
FIG. 10 shows measured absorption response obtained for an example mixture after repeated injections of different volumes of a sodium sulfide solution into a cadmium containing reagent.
Figure 11:
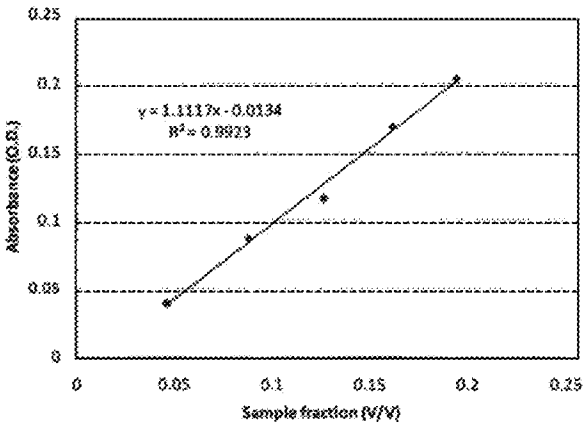
FIG. 11 shows peak absorption height obtained after subtracting a reference channel according to relative volume of a sample.

FIG. 10 shows the result of five injections of a 16.7 mM sodium sulfide solution ($Na_2S$) into a cadmium containing reagent (3.5 mM $CdSO_4$, 1.75% PAA solution in water). The injection time was 15 seconds and the injection volume was raised in steps of 12 μl (results for five such steps shown). The reagent flow rate was 1.0 ml/min and the five increasing injection flow rates were: 48, 96, 144, 192 and 240 μl/min.

The graph shows a clear increase during each injection period within the 400 nm absorbance response and only limited response at other reference wavelengths (i.e., 700 nm and 950 nm). It is apparent that the absorbance after a single injection is sufficient to determine the sulfide concentration in the sample. As can also be observed, the peak height after subtraction of the reference channel varies linearly with respect to the relative volume of the sample. The linear relationship is better observed in FIG. 11, in which the peak corrected absorbance values are plotted versus volume ratio of sample and reagent. The measured values fall substantially along a straight line, as shown. It is again apparent that a peak measured optical absorbance of the reagent-sample mixture can be used as an indicator as to sample fraction volume ratio, according to the linear relationship.

Figure 12:
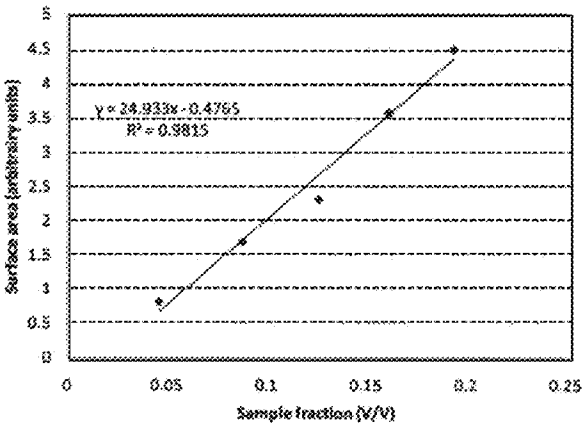
FIG. 12 shows areas determined underneath absorption peaks according to calculated concentration of an example mixture.

Another relationship between absorbance as function of injection time is shown in FIG. 12. In this instance, the area under each of the 400 nm injection peaks is integrated separately. The resulting areas of each of the five injection periods are plotted versus sample fraction of reagent-sample. In a similar manner, the measured values fall substantially along a straight line, as shown. It is again apparent that the surface area underneath the peak also shows a good relation with the calculated concentration. The surface area method is also less sensitive to lengthening of the peak. Furthermore, the surface area is independent of the injection rate if the injection point and the detector are sufficiently far apart. The time of flight to the detector (interrogator) should be longer than the injection time. At times, determination of the correct endpoint of the peak can be challenging using this approach.

To improve the accuracy of the measurement several measurements with different sample volumes can be made instead of a single measurement. The thus obtained linear slope between sample fraction and absorbance is directly related to the sulfide concentration but gives more accurate results.

Figure 13:
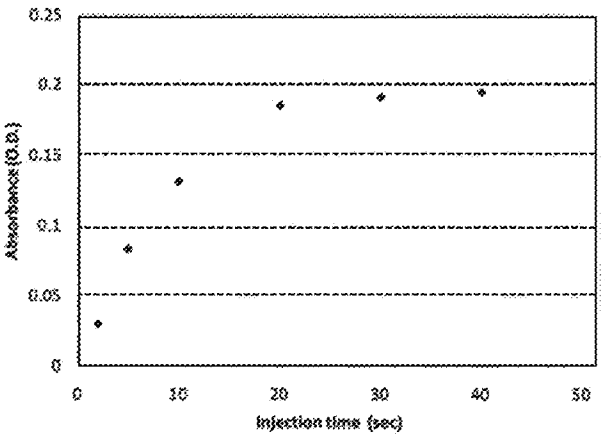
FIG. 13 shows absorption peak height versus injection time for an example mixture.

In flow injection analysis, the absorbance after a single injection is sufficient to determine the sulfide concentration in the sample. However, this peak height is strongly dependent on the flow rates and the injection time. Therefore, it is required to have accurate control over the flow rates and the injection time (volume). Furthermore, in at least some embodiments it is desirable that the calibration curve be obtained at the flow and volume conditions as will be used in the measurement. In such a calibration curve, the sensitivity (slope) of the absorbance to changes in concentration in a flow injection analysis is less than with continuous mixing. In continuous mixing, an equilibrium condition is reached, whereas in flow injection analysis such an equilibrium condition is not necessarily reached. FIG. 13 shows that maximum absorbance peak height is obtained at injection time of close to twenty seconds. These twenty seconds can also be seen as an example of a minimum time for the continuous mixing as described in continuous mixing mode of operation.

Schemes with More than Two Plungers

Figure 14:
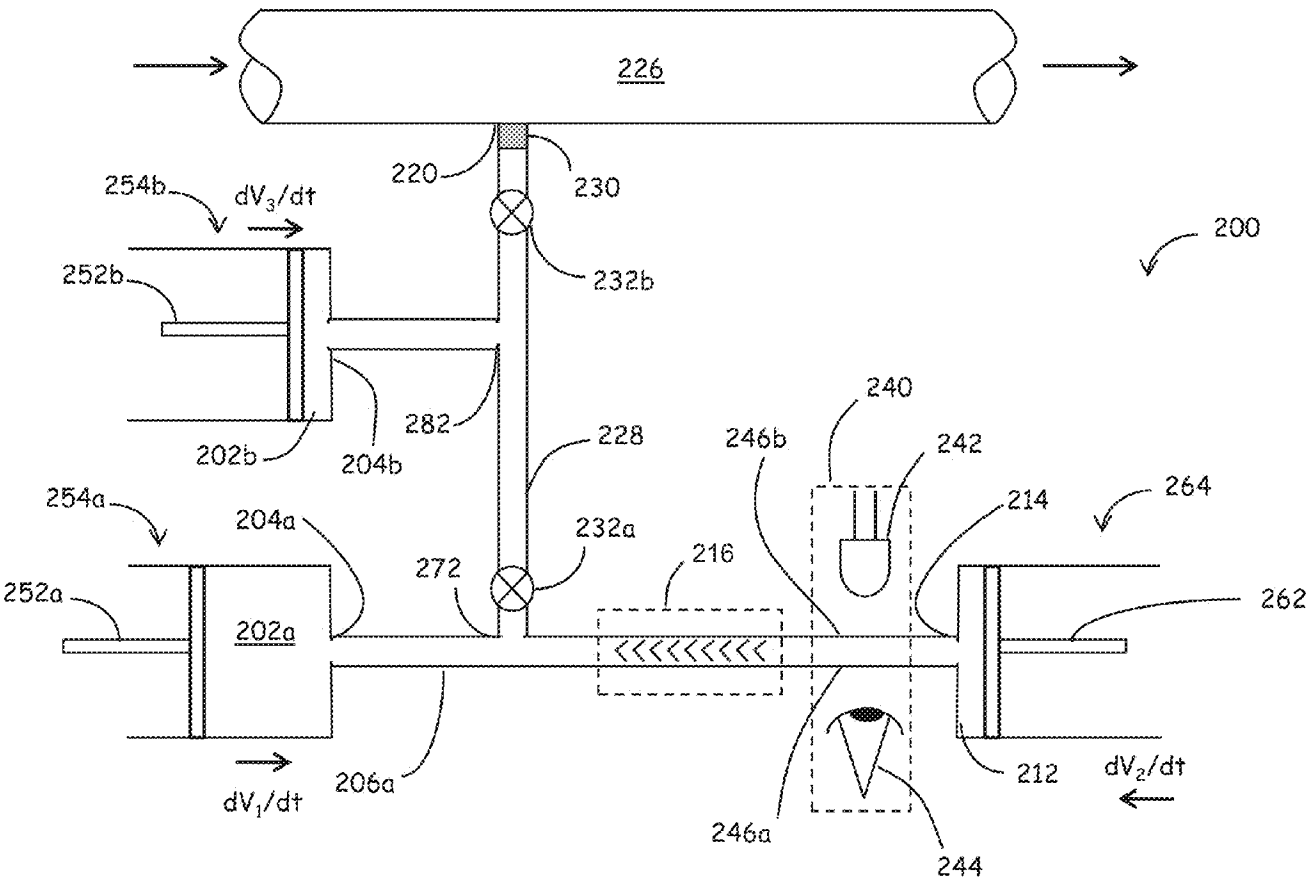
FIG. 14 shows a block diagram of an embodiment of a three-plunger device for mixing a sample with a reagent under downhole conditions.

Other embodiments of fluid analyzers are envisioned that allow for more complex fluid handling scenarios. For example, the addition of one or more additional variable-volume reservoirs and corresponding plungers creates many new opportunities. By way of example, FIG. 14 shows a diagram of a system 200 similar to the system 100 of FIG. 1 in that it includes a first fluid reservoir 202*a* having a first plunger 252*a* and a first pump 254*a* and a second fluid reservoir 212 having a second plunger 262 and a second pump 264. Open ends 204*a*, 214 of the first and second reservoirs 202*a*, 212 are similarly coupled to respective ends of a fluid conduit 206*a* and a fluid sample port 220 is in fluid communication with the fluid conduit 206*a* at a location between the first fluid reservoir 202*a* and a fluid mixer 216 arranged serially along the fluid conduit 206*a*. One or more filters 230 can be provided to filter fluid flowing from the flowline 226, through the sample port 220 and toward the fluid conduit 206*a*. An interrogator 240 is similarly configured to interrogate an optical property of fluid between the fluid mixer 216 and the second reservoir 212. Once again, in the illustrative embodiment, the fluid interrogator 240 includes windows 246*a*, 246*b*, a light source 242 and a detector 244 configured for measuring absorbance of the fluid.

The system 200 is distinguished form the previous example by a third fluid reservoir 202*b* having a third plunger 252*b* and a third pump 254*b*. A second valve 232*b* is provided between an open end 204*b* of the third fluid reservoir 202*b* and the sample port 220. The second valve 232*b* can be operated to selectively isolate or expose the sample conduit 228, including the third reservoir 202*b* to a flow of formation fluid from a high-pressure line 226 through the sample port 220.

The third plunger 252*b* with valves 232*a*, 232*b* can be used to selectively sample formation fluid from the flow line 226 and then push the sample through the system 200. For example, the second valve 232*b* allows the system 200 to obtain a fluid sample from the flowline 226. The third plunger 252*b* can be withdrawn, for example, expanding a volume of the third reservoir 202*b*. With the first valve 232*a* closed and the second valve 232*b* open, such action collects within the third reservoir 202*b* a sample from the flow line 226, while the second valve 232*b* is open and the first valve 232*a* is closed. After the first valve 232*a* is opened and the second valve 232*b* is closed, advancement of the third plunger 252*b* (i.e., collapsing the reservoir volume) pushes the fluid sample from the third reservoir 202*b* through the rest of the system 200, advancing it through the junction 272 and towards the mixer 216. The first and second pumps 254*a*, 264 can be operated to in a similar manner mix a reagent from the first reservoir 202*a* in a desired ratio and to collect any waste within the second reservoir 212.

In at least some embodiments, a background measurement of the fluid sample can be made before the reagent is mixed with the sample. The rate at which the plungers 252*a*, 252*b* are pushing determines the mixing ratio. In at least some embodiments, one or more of the plungers 252*a*, 252*b*, 262 can be passive, such that operation of the passive plunger accomplished by variation of the other two plungers to change volumes of the reservoirs 202*a*, 202*b*, 212 in a controlled manner. To the extent that the pumps 254*a*, 254*b*, 264 have engines driving their respective plungers 252*a*, 262, 252*b*, it is possible in at least some embodiments, for one of the plungers to be operated by pressure variations of the one or more of other plungers, such that an engine is not required for one of the plungers. This system configuration 200 is particularly useful when flow injection measurements are undertaken.

At least one advantage of this system 200 is that the second valve 232*b* can be used to isolate the system 200 completely from the flowline 226, even during periods of injection of a sample of formation fluid. This can be accomplished, since the sample once obtained, can be stored in the third reservoir 202*b* in anticipation of any subsequent chemical analysis. Such a capability removes the possibility that sensitive embodiments of the system 200, such as a microfluidic system, would be unnecessarily exposed to variations in flowline dynamics during periods of operation and during periods of non-operation. In fact, exposure of the system 200 to the flowline 226 can be limited to a brief period during which a sample of formation fluids is obtained from the flowline 226 and stored within the third reservoir 212.

Another variation of an at least three plunger system allows for the mixing of two or more different reagents, for example, one after the other, or in unison. This can be useful if two chemicals have to be added one after another or if two chemicals are not stable together. Such an approach includes a first junction 282 in the sample conduit 228 that allows for mixing a first reagent stored within the third reservoir 202*b* with a sample obtained from the high-pressure flowline 226, through the sample port 220. In operation, the first and second valves 232*a*, 232*b* can be opened allowing for a pressure balance between each of the three or more reservoirs 202*a*, 202*b*, 212 and the flowline 226, within the flowlines 228, 206*a* and the mixer 216. In at least some embodiments, the first reservoir 202*a* is pre-charged with a second reagent. Thus, a selective mixture of one or more of the reagents from the first and third reservoirs 202*a*, 202*b* and the sampled fluid can be obtained by selective operation of the three corresponding pumps 254*a*, 264, 254*b*. Rates of change of the three reservoir volumes $V_1$, $V_2$, $V_3$ resulting in a selective mixture. Accurate control of all the plungers is preferable for controlling such mixtures.

In yet another variation of the three or more plunger system, all three or more flows come together at one common location. This again is useful when two chemicals cannot be stored together. Another application is to use one of the pumps 254*a*, 264, 254*b* for cleaning. If the reaction of the sample with the reagent can cause precipitation or fouling of the optical window, one of the pumps 254*a*, 254*b* can be used to push a cleaning agent through the channels. Sufficient cleaning agent can be pre-charged in one of the reservoirs 202*a*, 202*b*, such that a predetermined number of cleaning cycles can be accomplished, the cleaning fluid passing through the mixer and past the location of the fluid interrogator 240.

Figure 15:
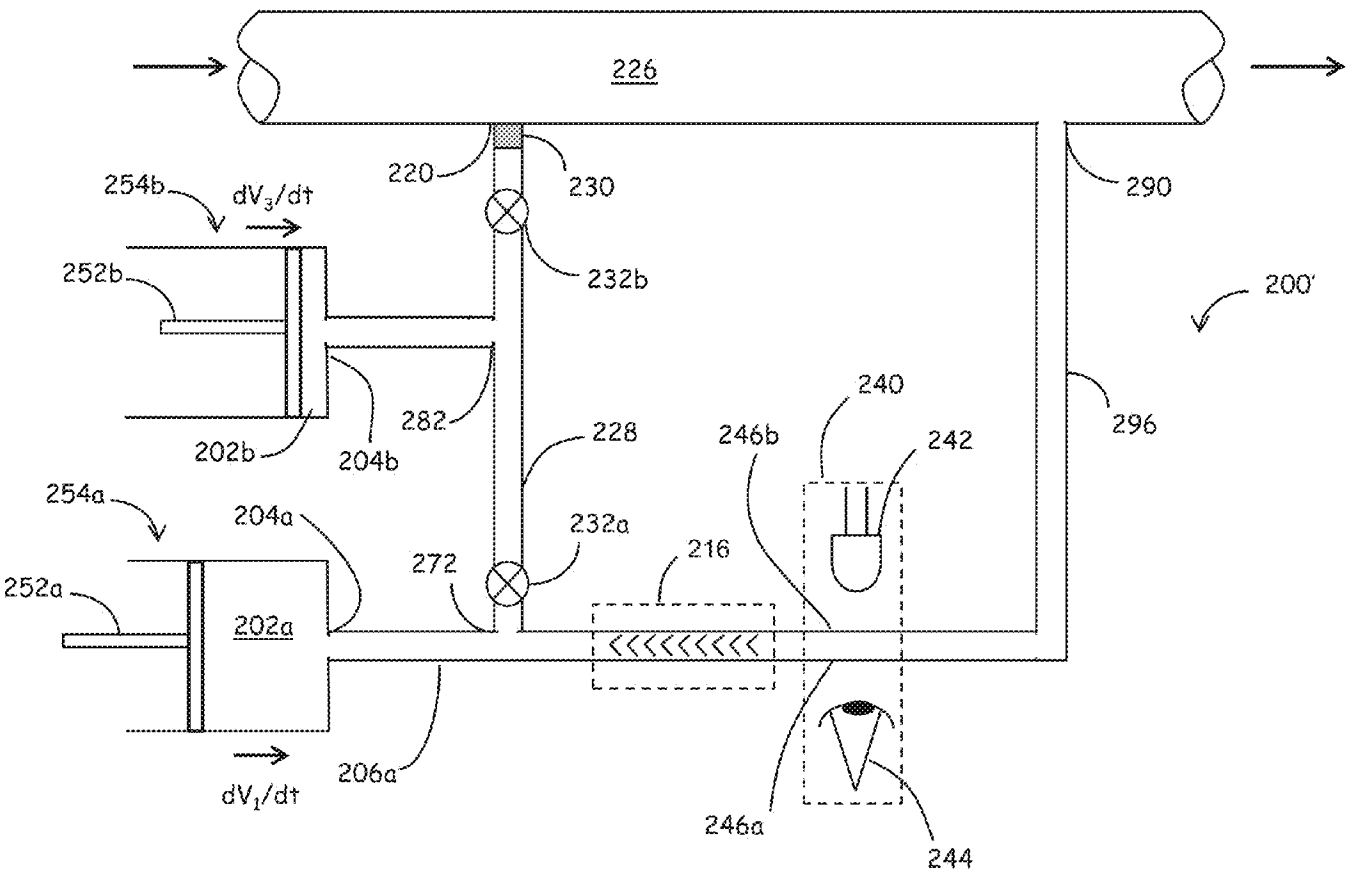
FIG. 15 shows a block diagram of another embodiment of a device for mixing a sample with a reagent under downhole conditions.

Referring next to FIG. 15, a variation of the above system is shown 200', in which the waste pump 264 is abandoned in favor of a direct connection back to the high-pressure flowline 226. In the illustrative embodiment, the mixture is controlled according to pump rates of the first and third pumps 254*a*, 254*b*. As the pumps 254*a*, 254*b* are advanced to push their respective contents into the mixer 216, the mixture is advanced through the return conduit 296 and toward a waste port 290 in the high-pressure flowline 226. Thus, any waste products are returned to the flowline 226 without being exposed to the wellbore environment. As fluid pressures are generally balanced within the fluid conduits 228, 206*a*, 296, except during moments of transition, exposure to the flowline pressure through the waste port 290 does not pose a problem.

In another variant (not shown), the system 200' is further adapted to accommodate more extensive tests, for example, for flow-injection mode operation. The variant system includes the two pushing plungers 252*a* and 252*b*, the mixer 216 and the fluid interrogator 240, also without a collection reservoir optionally without the first and second valves 232*a*, 232*b* can be used. The first reservoir 202*a* is filled with reagent whereas the third reservoir 232*b* is filled with sample. The use of a pre-filled reservoir 232*b* eliminates the first steps in normal operation: filling of the reservoir 232*b* with the first valve 232*a* closed and the second valve 232*b* open, followed by closing valve the second valve 232*b* and opening the first valve 232*a*.

Pressure Compensation

The force on any of the plungers (i.e., pistons) describe herein when at rest is dependent on the pressure difference over the plunger and the diameter of the plunger. During operation additional forces are active that depend on the density of the fluid and the rate that the plungers are moving. A very small diameter plunger (e.g., 1 mm or less) will generally require relatively small forces even under elevated pressures, such that a normal pump, or engine for driving the plunger is very feasible. However, for reservoirs configured to contain larger volumes of reagent, the diameter of the plunger and thus the plunger itself has to be larger. Stronger forces will require stronger engines to drive the plunger. The force on the plunger at rest is directly related to the diameter squared (i.e., the surface area of the plunger). In at least some embodiments, such excessive forces on relative large plunger can be reduced by lowering the pressure difference over the plunger.

Figure 16:
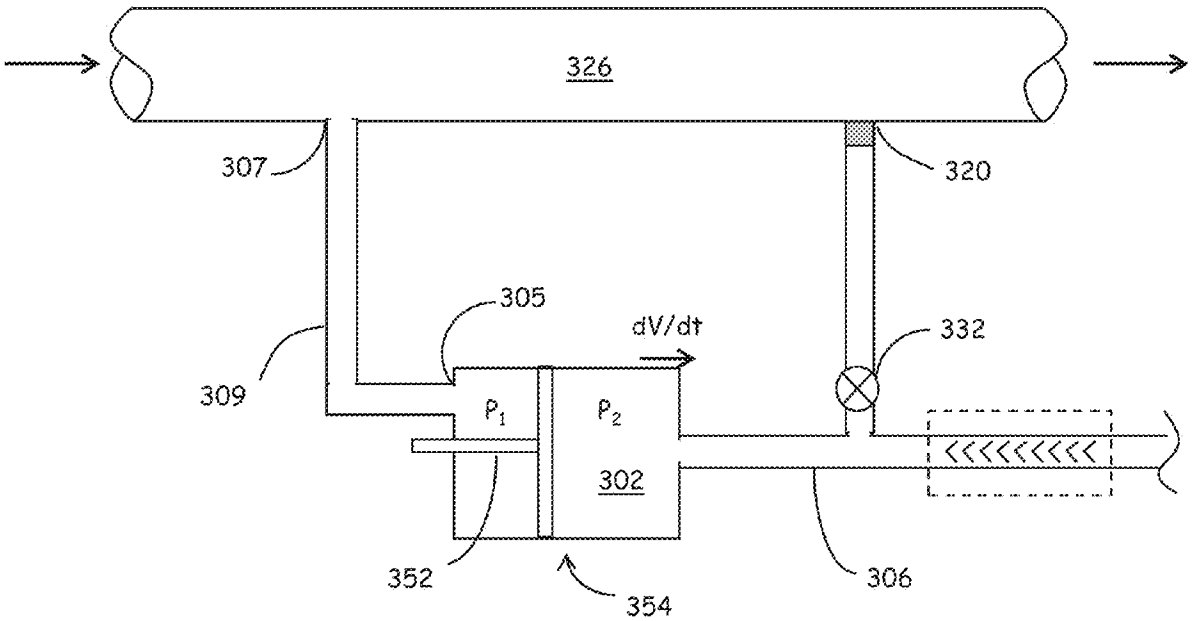
FIG. 16 shows a block diagram of an embodiment of a device for mixing a sample with a reagent under downhole conditions including a pressure-balanced pump.

FIG. 16 shows a pump 354 that includes a plunger 352 with substantially zero pressure difference over the plunger 352. The plunger 352 forms part of a variable volume reservoir 302. The reservoir 302 has an opening 305 to the flowline 326, open to an enclosed volume behind the plunger 352. The opening 305 is referred to as a first pressure balancing port 305. The first pressure balancing port 305 is in fluid communication with the high-pressure flowline 326 through second pressure balancing port 307. A second fluid channel 309 is in fluid communication between the first and second pressure balancing ports 305, 307. That portion of the fluid reservoir 302 arranged on a forward surface of the plunger 352 is also exposed to flowline pressure through the conduit 306 and the sample port 320. Thus, substantially equivalent pressure is exerted on either side of the plunger 352, the resulting forces acting on the plunger 352 being opposite and effectively cancelling each other. A valve 332 is provided between the sample port 320 and the fluid conduit 306.

As a result of such an open connection between a rear-facing surface of the plunger 352 and the high-pressure flowline 326, the pressure drop over the plunger 352 is minimized, such that relatively small pumps (engines) can be used to drive the plunger 352. If the second fluid conduit 309 between the flowline 326 and the plunger 352 is larger than the volume of the fluid reservoir 302, then the second fluid conduit 309 could be filled with a hydraulic fluid preventing fouling of the plunger 352. Furthermore, a valve 232 can be added preventing the damage to the plunger as result of sudden shocks during transportation or lowering the equipment in the well. Other pressure compensation techniques are also feasible. Such pressure compensation techniques can be applied to one or more of the plungers of any of the embodiments described herein.

Figure 17:
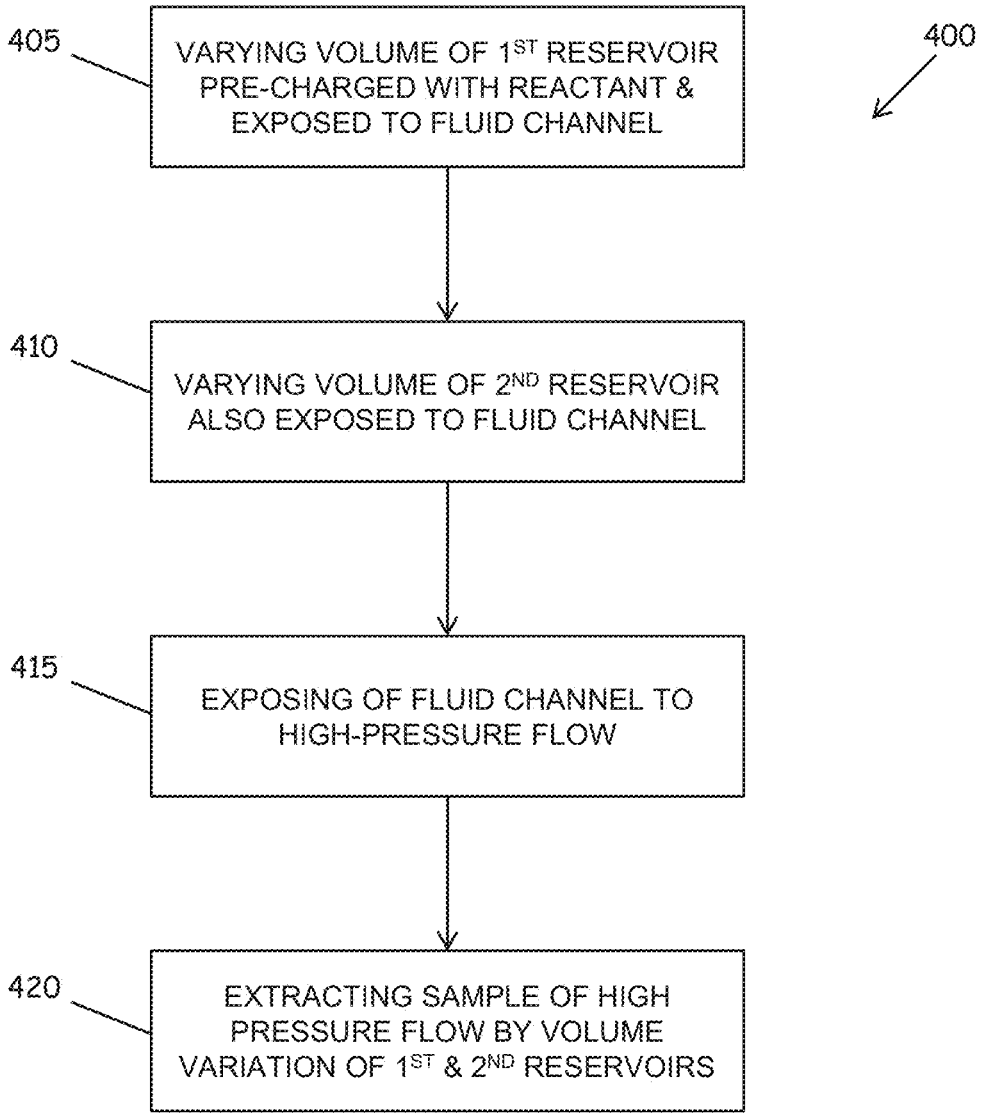
FIG. 17 shows an embodiment of a process for mixing a sample with a reagent under downhole conditions.

FIG. 17 shows an embodiment of a process 400 for mixing a sample with a reagent under downhole conditions. The process 400 includes varying a volume of a first reservoir at 405 pre-charged with a reactant and having an open end exposed to a fluid conduit. A volume of a second reservoir is also varied at 410, the second reservoir similarly having an open end exposed to the fluid conduit. A region of the fluid conduit between open ends of the first and second reservoirs is exposed at 415 to a high pressure flow of high-pressure fluids withdrawn from a subterranean formation. A fluid sample is extracted from the flow of high-pressure fluids at 420 responsive to relative variations of volumes of the first and second reservoirs.

Figure 18:
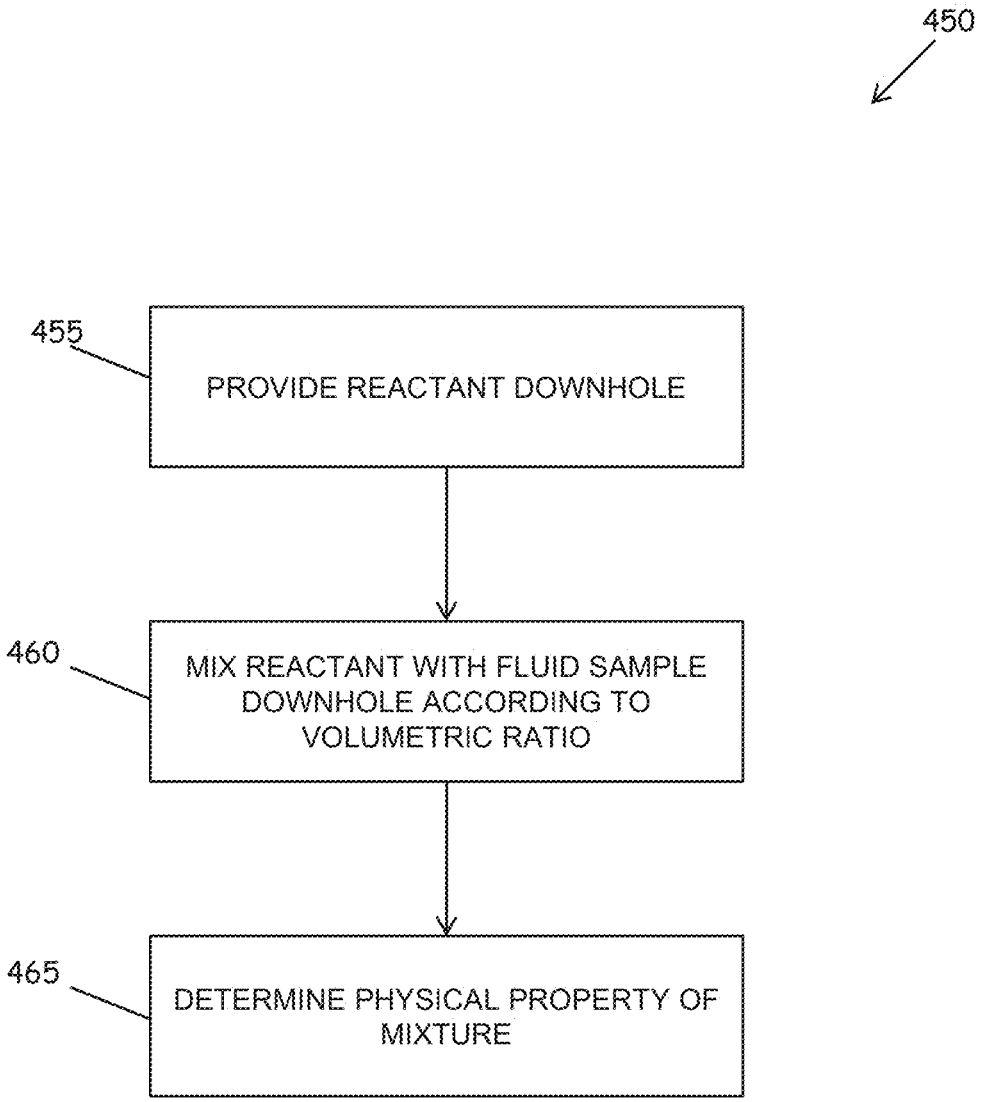
FIG. 18 shows an embodiment of another process for mixing a sample with a reagent under downhole conditions.

FIG. 18 shows an embodiment of another process 450 for mixing a sample with a reagent under downhole conditions. The process includes providing a reactant at 455 within a wellbore having an elevated temperature and pressure. The temperature and pressure within the wellbore are each substantially greater than corresponding temperature and pressure at a surface of the wellbore. At least a portion of the reactant is mixed at 460 with a sample of formation fluids, within the wellbore, according to a volumetric ratio. The resulting mixture has a physical property that is responsive to the volumetric ratio. The physical property of the mixture is determined at 465. In at least some embodiments, the determined physical property is indicative of a volume ration of the mixture.

The term "live fluid" is commonly used to refer to pressurized reservoir fluid samples that remain in single phase.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Further, the invention has been described with reference to particular preferred embodiments, but variations within the spirit and scope of the invention will occur to those skilled in the art. It is noted that the foregoing examples have been provided merely for the purpose of explanation and are in no way to be construed as limiting of the present invention.

While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

We claim:

1. A downhole fluid processing apparatus, comprising:

a first variable-volume reservoir pre-loaded with a reactant and having an open end in fluid communication with a fluid conduit;

a second variable-volume reservoir having an open end in fluid communication with the fluid conduit;

a fluid mixer disposed along the fluid conduit;

a sample port configured to receive from a flowline a fluid sample withdrawn from a subterranean formation, the sample port being in fluid communication with the fluid conduit at a location between the open end of the first variable-volume reservoir and the fluid mixer, wherein the reactant is different from the fluid sample and a selectable mixture of the reactant and the fluid sample is obtainable by varying volumes of the first and second variable-volume reservoirs.

2. The apparatus of claim 1, further comprising an isolation valve disposed between the sample port and the fluid conduit, the isolation valve adapted to selectively isolate the sample port from the fluid conduit.

3. The apparatus of claim 1, further comprising a filter disposed between the sample port and the fluid conduit.

4. The apparatus of claim 1, further comprising a fluid interrogator positioned to interrogate a physical property of the mixture of the reactant and the sample fluids.

5. The apparatus of claim 4, wherein the fluid interrogator is configured to interrogate a property selected from the group consisting of: optical properties, electrical properties, chemical properties.

6. The apparatus of claim 5, wherein the fluid interrogator comprises a spectrometer.

7. The apparatus of claim 1, wherein at least one of the variable-volume reservoirs comprises a syringe pump.

8. The apparatus of claim 1, further comprising:

a third variable-volume reservoir having an open end in fluid communication between the sample port and the fluid conduit;

a first isolation valve disposed between the open end of the third variable-volume reservoir and the sample port, the first isolation valve adapted to selectively isolate the third variable-volume reservoir from the sample port, while allowing fluid communication between the third variable-volume reservoir and the fluid conduit; and a second isolation valve disposed between the open end of the third variable-volume reservoir and the fluid conduit, the second isolation valve adapted to selectively isolate the third variable-volume reservoir from the fluid conduit, while allowing fluid communication between the third variable-volume reservoir and the sample port.

9. The apparatus of claim 8, wherein at least one of the first, second and third variable-volume reservoirs comprises a pressure-balance port in fluid communication with the flowline, the pressure balance port enabling volume variation of the at least one of the first, second and third variable-volume reservoirs exposed to flowline pressure without having to overcome flowline pressure.

10. The apparatus of claim 1, wherein at least one of the first and second variable-volume reservoirs comprises a pressure-balance port in fluid communication with the flowline, the pressure balance port enabling volume variation of the at least one of the first and second variable-volume reservoirs exposed to flowline pressure without having to overcome flowline pressure.

11. The apparatus of claim 1, wherein the fluid conduit comprises a microfluidic channel.

12. The apparatus of claim 1, wherein the fluid mixer is serially disposed along the fluid conduit at a location between open ends of the first and second variable-volume reservoirs.

13. The apparatus of claim 1, further comprising a waste port for coupling the fluid conduit to the flowline.

14. A method for analyzing a fluid sample within a wellbore, comprising:

varying a volume of a first reservoir pre-charged with a reactant and having an open end in fluid communication with a fluid conduit, wherein the reactant is different from the fluid sample;

varying a volume of a second reservoir having an open end in fluid communication with the fluid conduit;

exposing a region of the fluid conduit to a flow of fluids obtained from a subterranean formation; and extracting the fluid sample from the flow of fluids responsive to relative variations of volumes of the first and second reservoirs.

15. The method of claim 14, further comprising selectively mixing together at least a portion of the reactant and at least a portion of the extracted fluid sample responsive to relative variations of volumes of the first and second reservoirs to form a reactant-sample mixture.

16. The method of claim 15, wherein selectively mixing comprises agitating a combination of at least a portion of the reactant and at least a portion of the extracted fluid sample.

17. The method of claim 16, wherein detecting the physical property of the reactant-sample mixture comprises detecting a physical property of the reactant-sample mixture selected from the group consisting of: optical properties, electrical properties, chemical properties.

18. The method of claim 15, further comprising detecting a physical property of the reactant-sample mixture.

19. The method of claim 18, wherein selectively mixing comprises injecting a sufficient portion of the reactant, such that a maximum response of the detected property is obtained.

20. The method of claim 18, wherein selectively mixing comprises injecting less than a sufficient portion of the reactant than would otherwise yield a maximum response of the detected property.

21. The method of claim 18, further comprising:

detecting a baseline physical property of at least one of the sample and the reactant; and adjusting the detected physical property of the reactant-sample mixture responsive to the detected baseline.

22. The method of claim 15, further comprising collecting at least a portion of the reactant-sample mixture, thereby avoiding exposure to a local environment.

23. The method of claim 22, wherein the act of collecting comprises injecting at least a portion of the reactant-sample mixture into a high pressure flow of high-pressure fluids.

24. The method of claim 14, further comprising decreasing the volume of the first reservoir while equivalently increasing the volume of the second reservoir for a predetermined time, thereby pre-loading the fluid conduit with at least a portion of the reactant.

* * * * *